United States Patent [19]

Harmsen et al.

[11] Patent Number: 4,992,029

[45] **Date of Patent: * Feb. 12, 1991**

[54] MINIATURE AXIAL FAN

[75] Inventors: Siegfried Harmsen, St. Georgen; Gunter Wrobel, Villingen, both of Fed. Rep. of Germany

[73] Assignee: Papst Motoren GmbH & Co., Fed. Rep. of Germany

[ * ] Notice: The portion of the term of this patent subsequent to Feb. 21, 2006 has been disclaimed.

[21] Appl. No.: 312,971

[22] Filed: Feb. 21, 1989

Related U.S. Application Data

[63] Continuation of Ser. No. 221,947, Jul. 6, 1988, Pat. No. 4,806,081, which is a continuation of Ser. No. 928,476, Nov. 10, 1986, abandoned.

[30] Foreign Application Priority Data

Nov. 8, 1985 [DE] Fed. Rep. of Germany ..... 3539623

[51] Int. Cl.[5] ..... F04D 25/08; F04D 29/44

[52] U.S. Cl. ..... 417/354; 417/423.14

[58] Field of Search ..... 417/354, 353, 352, 423 R, 417/423 G, 423 T, 423.1, 423.7, 423.14; 416/223 R, 243, 170 C, 241 A; 415/207

[56] References Cited

U.S. PATENT DOCUMENTS

| | | | |
|---|---|---|---|
| 2,926,838 | 3/1960 | Van Rijn | 417/354 |
| 3,362,627 | 1/1968 | Papst | 417/354 |
| 4,063,852 | 12/1977 | O'Connor | 416/223 R |
| 4,120,609 | 10/1978 | Chou et al. | 416/223 R |
| 4,373,861 | 2/1983 | Papst et al. | 417/354 |
| 4,639,193 | 1/1987 | Reichert et al. | 416/241 A |

FOREIGN PATENT DOCUMENTS

| | | | |
|---|---|---|---|
| 100078 | 7/1983 | European Pat. Off. . | |
| 2252415 | 5/1973 | Fed. Rep. of Germany | 417/353 |
| 1110068 | 2/1956 | France | 416/223 R |
| 348501 | 10/1960 | Switzerland | 416/223 A |
| 519032 | 3/1940 | United Kingdom | 416/223 R |
| 2133082 | 7/1984 | United Kingdom | 417/354 |

*Primary Examiner*—Louis J. Casaregola
*Assistant Examiner*—Timothy S. Thorpe
*Attorney, Agent, or Firm*—Barnes & Thornburg

[57] ABSTRACT

The invention relates to a miniature axial fan particularly of an axially compact construction, having a central motor driving a rotor disk with a housing surrounding the rotor disk in which an interior housing wall on the inflow side is cylindrical and extends past the axial center of the housing and then this cylinder wall expands outwardly to the outlet side of the housing to produce an enlargement of the flow cross-section. The housing has webs extending inwardly from the outlet side of the housing that carry the central driving motor with the rotor disk. A number of blades are mounted on the rotor disk which numbers differs from the number of webs.

1 Claim, 3 Drawing Sheets

MINIATURE AXIAL FAN

This is a continuation of U.S. Pat. No. 4,806,081 application Ser. No. 07/221,947 filed July 6, 1988, which is a file wrapper continuation application of application Ser. No. 06/928,476, filed Nov. 10, 1986, now abandoned.

The invention relates to a miniature axial fan according to the introductory part of claim 1.

In the case of axial fans of such a small size, there is, in addition to the often required compactness, the requirement of a low noise level and of an air output that is sufficient for its use. Because of the given small outside dimensions that is not easy to achieve. In the range of these dimensions and below, there is therefore a struggle involving millimeters. If one parameter, one dimension is changed by a few millimeters in favor of one characteristic, this has a considerable effect on other characteristics and thus on the overall characteristics.

On the basis of the European Patent Application 0100078, an axial fan is known that is suitable for developments of compact axial fans having a rotor disk diameter of below 100 mm.

The inventive combination that is to be protected here used a part of the characteristics known from that text in combination with other measures that are specifically effective in the case of an axial fan of the initially mentioned small size.

The invention is therefore based on the objective of developing a very small, relatively compact axial fan having a rotor disk driven by a concentric coaxial driving motor in such a way that, in the case of the small size offered here, it has a relatively good air output and a low noise level.

The invention is achieved by the means listed in claim 1.

The figures show embodiments of the invention

Figure 1:
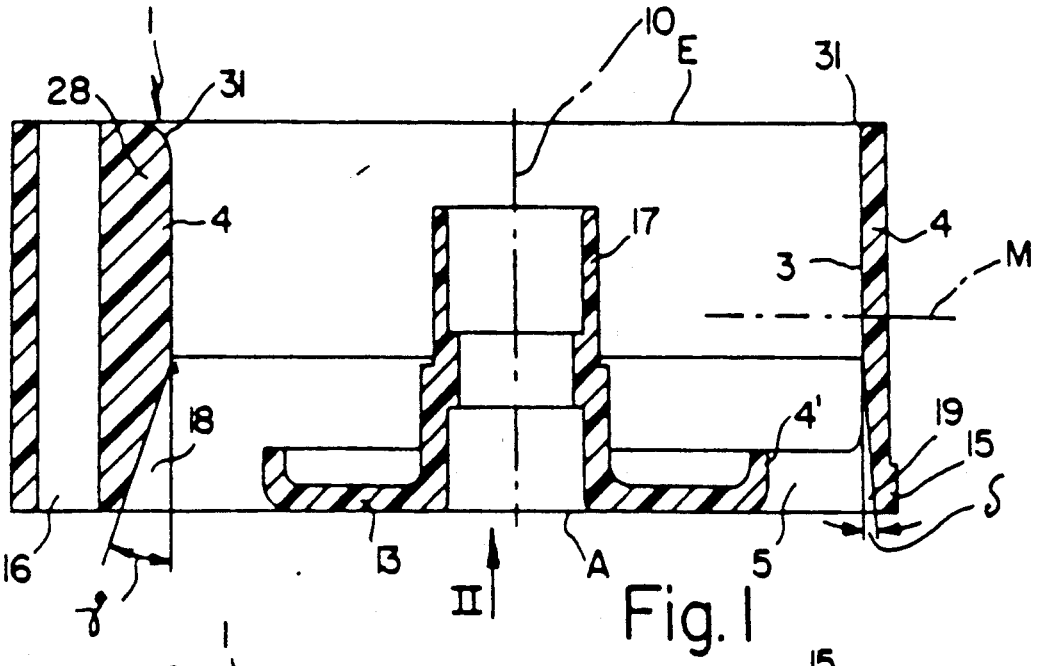
FIG. 1 is a sectional view along the Cutting Line I/I of FIG. 2.
Figure 2:
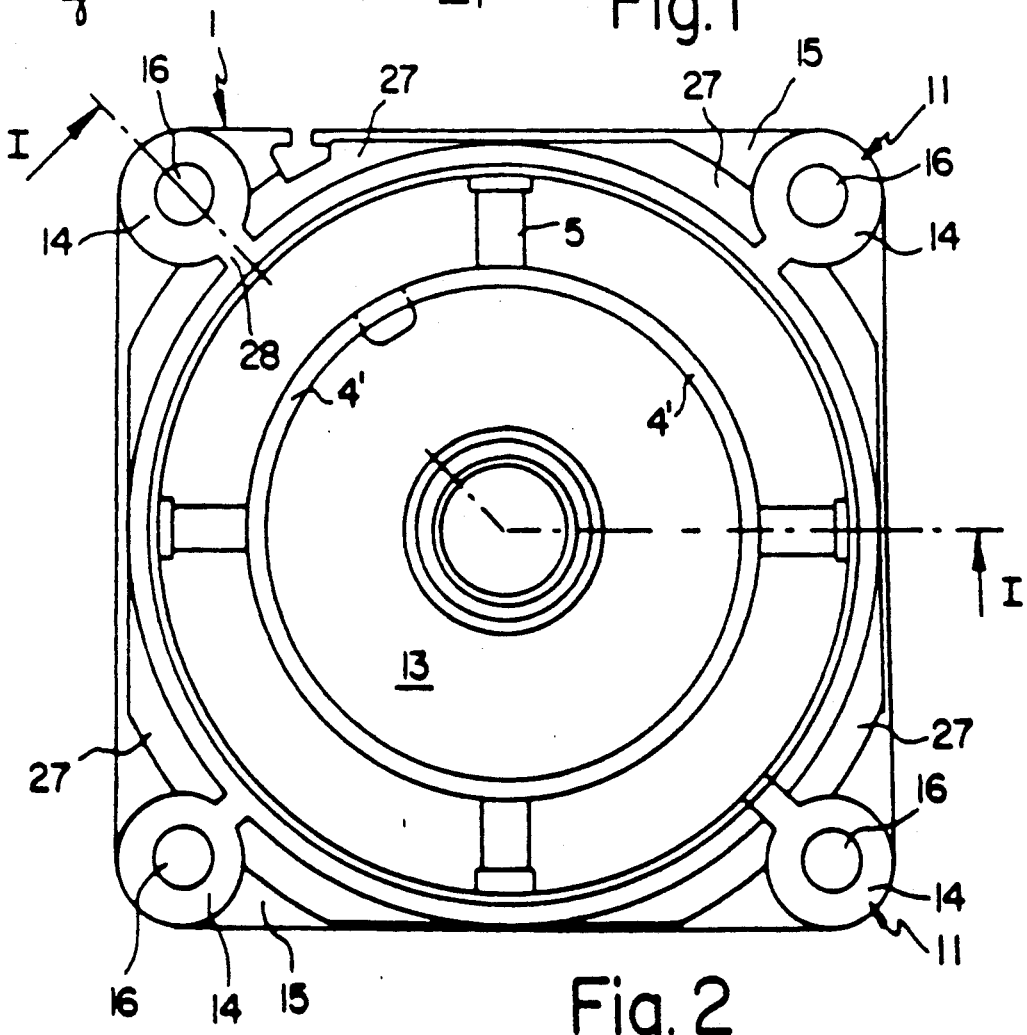
FIG. 2 is a top view in the direction of the Arrow II of FIG. 1.
Figure 4:
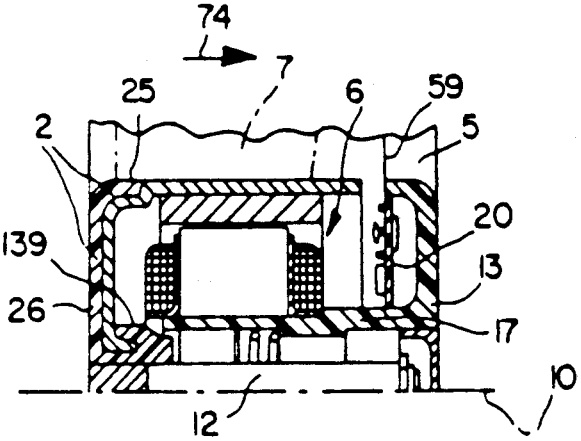
Figure 3A:
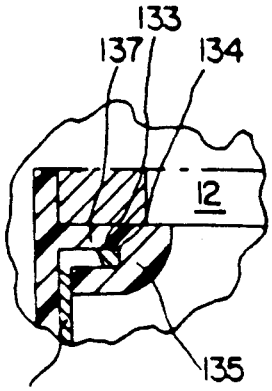
Figure 3:
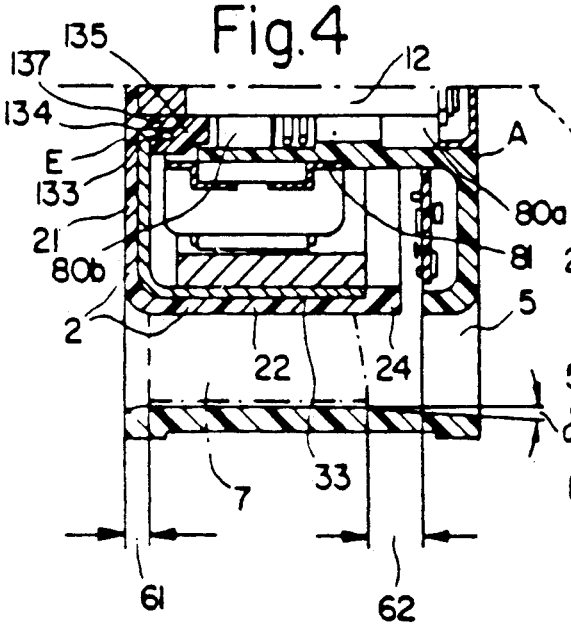

FIGS. 1 and 2 together shown in twice their real size, thus at a scale of 2:1, show a fan housing into which a rotor disk with a coaxial driving motor can be inserted, as shown in FIG. 3 or 4.

FIGS. 3, 3a, 4, 5 show variants of such driving motors according to the invention having a rotor disk in twice the real size, in which case the outer rotors of the driving motor and the rotor disk hub are developed differently. The electronic commutating system is in each case provided in the flange.

Figure 6:
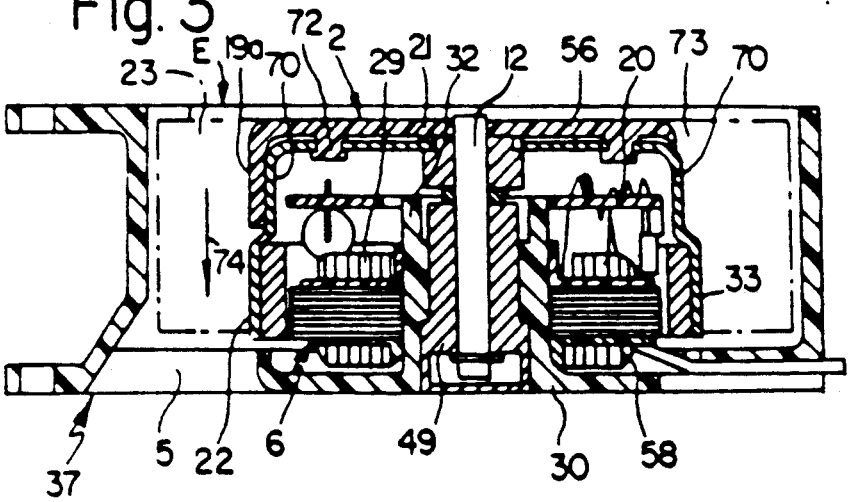

FIG. 6 is an embodiment with an additional or alternative fastening of the plastic rotor disk on the outer rotor can by means of heat-upsetting. In addition, an electronic commutating system is provided there on a ring-shaped support under the outer rotor cap.

Figure 7:
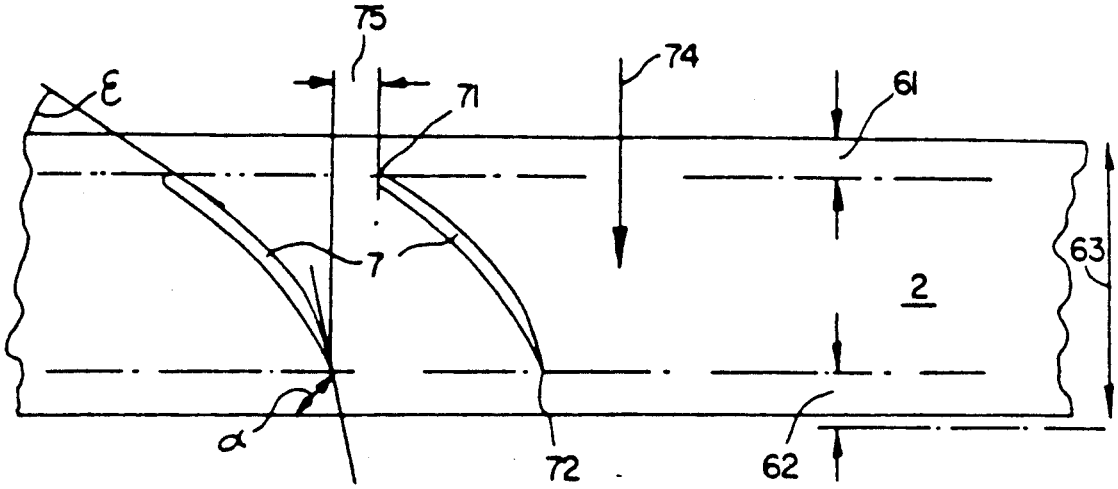
Figure 8:
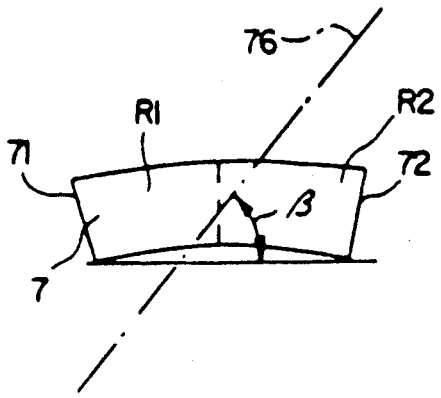

FIGS. 7 to 9 are details of the blade dimensioning for the rotor disk, such as according to FIG. 3.

FIG. 1 shows a bent longitudinal section through the housing of a miniature fan according to the invention. Concentrically to the rotational axis 10, a bearing tube 17 is designed in a stepped way for stops of bearings and positioning of the stator body.

The bearing tube 17 forms one piece with the flange 13, to which four webs 5 connected distributed by 90° that radially, in each case, extend into the center of a square side, continue there into a square flange plate 15, out of which the housing tube 4 or 1 extends axially with its cylindrical interior wall surface 3 to the inlet plane E. Radially outside the housing tube 1, the fastening columns 14 are provided that also extend out of the flange plate 15 from the outlet plane A axially to the inlet plane E. All these parts 17, 13, 5, 4, 1, 14, 15 are developed as a one-piece plastic injection molded part. The fastening column 14 that have the full axial length of the fan and have a compact construction, provide an excellent stiffness for the fastening of the minifan. In addition, by means of this design that inside and outside the flow duct, provides only one joint face (with respect to tools), an inexpensive tool becomes possible (sic - translator). The fastening bores 16 are let into the columns 14 concentrically.

The enlarging spaces 18, 19 with the enlarging angles $\gamma$, $\delta$ at the outlet plane A that extend from the cylindrical part of the interior wall surface 3 to the outlet plane A, signify, first by means of their very small angle $\delta$, that the removing from the tool is ensured, by means of which, at the same time, also an increase of the cross-section is achieved, even though it is minimal. The cylindrical part of the interior wall surface 3, for reasons of manufacturing technology, at least in the case of the injection-molded piece, must have an incline for lifting-out, i.e., this cylindrical part is only essentially cylindrical (compare angle $\delta$). The enlarging spaces 18 into the four corners of the square with the significantly larger enlarging angle $\gamma$ are known per se from the German Patent Text 17 28 338. The enlarging spaces 18 also extend conically (or also in steps) to the outlet plane A (from the direction of the cylindrical part 3 of the flow duct).

The diagnonal wall of the enlarging spaces 18 is shown from the outside in FIG. 2 (compare number 27). Between the fastening columns 14 and the housing tube 1, continuous bridges 28 are provided that provide the stability of the columns 14 also to the housing tube 1. On the side of the inlet, the interior wall surface 3 has a rounded off area which in practice, in its real size, has a bending radius of about 4 to 5 mm.

The real size of FIGS. 1 and 2 is therefore that of a cuboid of 50×50×25 mm. In the present construction that is shown in FIG. 1 and 2, the combination of an optimal flow duct, a relatively high stability of the housing structure, an economical manufacturability as a series product, also with dimensions of such a small size, is possibly of inventive significance. For this reason, measurements and proportions may also have this significance. The columns 14 that are developed as round bolts with the continuous fastening bolts 16 and the thin bridges 28 that nevertheless continue over the whole axial length of the housing radially to the thin housing ring 1, make possible an optimal construction also for a simple tool.

Figure 5:
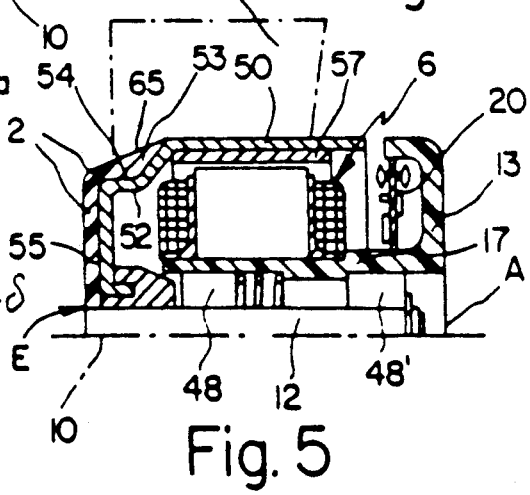

In FIGS. 3, 4, 5, the bearing tube 17 and the flange 13 are constructed as shown in FIG. 1. The armature stampings of the stator are fitted onto the exterior (extreme-translator) step of the bearing tube 17, and strike against this step with insulating end plates. In the interior of the bearing tube, a pair of ball bearings is indicated in a known way that are braced axially with a spring for the bearing of a shaft that in a torsionally fixed way is connected with the outer rotor housing or the rotor disk hub. FIGS. 3 to 5 are constructed differently only with respect to this outer rotor cap and the rotor disk hub. In all three cases, identical blades 7 can be combined on a hub 21 into a rotor disk 2 Thus also the armature stampings are identical with the winding of a driving motor 6, also the electronic commutating system-immersing axially into the flange shell 13.

In the case of axial fans of this small size, it is important, in the case of the relatively large driving motor 6, i.e., a relative large ratio of the rotor disk hubs—or the driving motor diameter—to the diameter of the rotor disk, i.e., that of the envelopes of the blade ends, to make the radial dimension of the blade relatively large, i.e., to construct the driving motor with the hub together for a small diameter of the interior flow wall. This interior flow wall is formed by the hub and the outer rotor. The object of FIGS. 3, 4, 5 is to provide conditions that are favorable in this respect; i.e. to achieve a certain output requirement and a secure fastening of the rotor disk blades 7 at the plastic hub, as well as of the fan wheel on the outer rotor and to nevertheless make available a sufficient air output.

In FIG. 3, a plastic-bound magnet is used (or a ceramic magnet, but always still) of a relatively large thickness, over which a relatively thin bowl-shaped cap 33 of low retentivity is pulled. The rotor disk hub 21, with its cylindrical exterior part 22, completely reaches around the cap 33, whereby a good anchoring is achieved by means of the fact that at the open end 24 of the bowl, the plastic is thickened, i.e., by means of the plastic a form-locking holding of the outer rotor is achieved by means of the fact that the injection molding takes place around it, wherebY the exterior part 22 with the radial wall 21 as a whole is combined into bowl-shaped hub and with the blades 7 into a rotor disk 2 that in the known way is developed in one part as an injection-molded part.

FIG. 3 shows a further independently important economically advantageous method and structure to fix the rotor 2 on the shaft 12 by mere plastic injection molding. The soft-iron cap 33 with its inner axially bent collarlike rim 133 there is completely embedded in the plastic means. The internal surface 134 of said collar has a distance of about 0.5 to about 2 mm to the shaft 12, preferably 0.6 mm. This distance or gap 137 is filled with plastic and the collar or rim is partly perforated, so that the plastic part 135 surrounds and penetrates the rim or collar 133. The gap is as small as possible so that plastic material, when injected, penetrates the gap. Because of heat problems the gap should not be larger than 1 to 2 mm. Said cylindrical collar surrounding said shaft is fixed with the rotor in any way.

FIG. 4 shows a known, more costly method where a separate additional metal piece between the shaft and the collar is necessary.

The method of FIG. 3 is important, independently of the type of fan or structure of the rotor housing.

In FIG. 3, the internal rim of the rotor-holding reinforcement element 33 is punched and bent in one step with the whole caplike element 33.

FIG. 4 shows a cylindrical part 25 of a rotor disk hub that, only projecting out over a relatively small part, about one fourth of the axial length, reaches over the outer rotor of the driving motor. The bowl-shaped housing 33 of the outer rotor that is of low retentivity on it bottom side is reduced in its diameter in steps so that a cylindrical outer surface makes possible a press fit for the plastic hub 25, 26, in which case its outside diameter corresponds approximately to the outside diameter of the rotor bowl (or can- translator). In this way, with otherwise identical engine dimensions, a slightly larger cross-section is obtained by the elimination of the cylindrical exterior wall 22 of the plastic hub. Naturally, in the case of FIG. 4, the plastic hub with the radial front surface 26 and the cylindrical part 25 that is developed as a ring collar are injection-molded in one piece with the blades 7. In this case, this important expansion of the flow cross-section, i.e., reduction of the driving motor in its diameter including the rotor disk hub, takes place by such a reduced diameter.

Should the mounting of this rotor disk on the outer rotor not be good enough, it may, as shown in FIG. 6, be held in addition (or also as an alternative) in the bottom of the outer rotor by means of journals that are upset by heating. This would make it possible that the cylindrical projection 25 can be eliminated. In that case, a cone-type tapering could be provided in the direction of the inlet plane E. The reason is that this type of cone-type tapering of the rotor disk hub in the direction of the inlet plane E would make possible an additional improvement of the flow behavior, particularly if, on the outside, the limiting housing wall were to extend at first cylindrically from the flow-in side, as is known on the basis of EP-0100 078-A1 (EU-456).

In principle, it can be stated that this hot upsetting of the rotor disk hub in the front side of the outer rotor cap, as shown in FIG. 6, is useful as an additional measure or as an alternative. There a glueing-together or riveting-together may also take place so that, in the area of the reduced diameter, as shown in FIG. 6, by means of a conical outer contour of the rotor disk hub or one that tapers in the direction of the inlet plane E, as a whole, clearance 71 is created. That is also shown on the right-hand side of FIG. 6 where it is shown clearly that the ring part was left out.

If the rotor disk is made of a fiber-glass-reinforced plastic, this type of construction can be afforded. The blades will nevertheless adhere with the required stiffness to the only disk-shaped hub 56. If the rotor disk is a metallic punched bent part, it is advantageous to rivet the disk-shaped hub together with the rotor of the driving motor.

FIG. 5 shows an additional variant, where by means of a radially deeper step, a further enlargement of the flow cross-section is achieved.

By means of a more extensive reduction of the outer diameter of the housing 50 to the cylindrical step 52, that there is reduced to a diameter of 50 to 80%, because of the relatively small ring part 53 of the hub, that is still a sufficient amount of cross-section in order to achieve a perfect press fit not only on the outer surface 54 of the housing step 52, but in addition, because there is sufficient cross-section, the outer contour of the plastic hub with its overlapping ring part 53 can be constructed in such a way that it has a conical surface 65 that tapers in the direction of the inflow plane E, which again is favorable with respect to the flow, which is shown above in connection with FIG. 6, right-hand side. If the surface 65 extends axially at least over ⅓ of the flow duct length, this tapering is quite effective. Particularly by means of the concept of FIG. 5 that is described in the following, this minimal length can be achieved in practice in the mass-produced product without any problems. In the case of this embodiment, less demands are made on the plastic that carries the one-piece rotor disk 2 with the blades 7, with the ring part 53, with the radial bottom wall 55 so that the plastic in this case may possibly be less expensive. In the case of FIG. 5, it is also provided that a rare-earth alloy, such as samarium cobalt, is used for the rotor magnet 57. It is known that these types of magnets require a much smaller volume so that the permanent magnet in the tube radially may also be much thinner which, again in the case of the same air gap (the same magnetic conditions are a prerequisite), results in a further reduction of the outside diameter of the can 50. These advantageously small outside diameters of the driving rotor (in the case of the samarium-cobalt permanent magnet solution- used here) and the radially extensive reduction of the step 52 (i.e., in the case of a ratio of the diameter of the step 52 to the diameter of the cylindrical part 50 of the outer rotor housing of 0.5 to 0.8) results in an effective conical tapering of the engine rotor disk hub in the direction of the inlet plane E. Again, in the case of FIG. 5, the same rotor may be provided as in FIG. 3 or 4 so that therefore the same air gap diameter applies. It is shown that in the case of FIG. 5 the whole natural wall thickness of the rotor bundle with the parts 50 and 57 is about 1 to 2 mm, and in the case of FIG. 3, it is about 3 to 4 mm which signifies a reduction of diameter of about 4 mm which is very important in the case of this small size (hub diameter about 30 mm) because the flow cross-section is significantly improved by the enlargement and design. This concept of FIG. 5 is basically advantageous for miniature fans with a central motor, particularly with outside rotors, independently of the housing. It is also advantageous for miniature, so-called "motor rotor disks" (i.e. motors in which the rotor disk is placed on the motor). It is not only for rare-earth rotor magnets (with or without cobalt), but very effective for them. Weaker magnets signify a slightly larger "hub" diameter.

In FIG. 6, on the left-hand side, a slightly different variant of a fan according to the invention is provided, in which a reduction of the outside diameter of the motor hub is visible.

FIG. 6 shows an injection-molded plastic fan wheel 2 having a hub 19*a* which carries the evenly distributed blades 7 on its periphery. It is pressed over the hub part 70 of the outside rotor housing 22 that is reduced in its diameter and is fastened in a fitting way. The outside diameter of the plastic hub 21 corresponds largely to the outside diameter of the rotor housing 22 near its open end.

The advantage of the plastic fan wheel is the fact that it results in an altogether cost-effective axial fan. It is also understandable that the outside diameter of the hub 21 is still smaller than this would be the case if this hub were to completely reach over the outside rotor of the driving brushless direct-current motor. Therefore the rotor constructed according to FIG. 6 with the fan wheel that is placed on it is advantageously used in very small axial fans, like the object of the present invention. The reason is that here, in the range of a rotor disk diameter of 30 to 60 mm with a coaxial "hub" motor, a minimal reduction of the rotor disk hub diameter is quite advantageous for the flow behavior (air volume/-time and noise).

Although it is shown in FIG. 6 that the central fastening part 32 is the bearing tube, it should be clear that for many usages the central fastening part could also consist of only the interior side of the iron core 58 of the stator. Thus, the stator iron could be used as a fastening either for the ball bearings 48, 48' or for the slide bearings 49 in the case of certain usages of the brushless direct-current motor. The printed circuit board 20, in this case, would be fastened by means of pins at the appropriate point of the stator.

A further improvement of the structure consists of equipping the motor of FIG. 6 with the fan housing 37, the central fastening part 32, the flange 30 as well as the webs 5 that are cast out of a single plastic part.

Thus, in correspondence with this invention, an interior motor structure was shown for a brushless direct-current motor having an electronic driving system and a revolutions/min. control circuit that, on the inside of the motor, is fastened on a master board in such a way that it is possible to obtain in steps a smaller diameter at the closed end of the hub of the outside rotor than at the open end of the outside rotor. This type of diameter that becomes smaller in steps makes it possible that this type of motor be used for axial fans having a larger cross-section on the air inlet side of the fan, particularly in the case of a fan with smaller dimensions, as well as for usages where it is important that larger amounts of air be supplied at a higher pressure.

FIG. 7 is a partial view of the rotor disk hub 2, particularly according to FIG. 3. The blades 7 are arranged in an unevenly distributed way at the circumference of the rotor disk hub 2. The clearance 75 (in this case about 3 mm) is varied in this case in order to reduce noise. The flow direction is indicated by the arrow 74. The inlet edges 71 of the blades 7 are staggered by a first axial distance 61 from the inlet plane E in the direction of an Arrow 74 that indicates the flow direction. In the embodiment according to FIG. 3, for example, this distance 61 is 3 mm. The inlet edge is developed with a radius of about 0.6 mm. In the last third, the blade 7 is tapered and ends at the outlet edge 72 with a thickness of 0.4 mm. The outlet edge 72 is set back by a second distance 62 in the opposite direction of the Arrow 74 from the inner web edge 59 of the webs 5, namely preferably 4 mm (compare FIG. 3). The axial dimension 63 of the rotor disk 2 (according to FIG. 3) is about 20 mm. The inlet angle $\epsilon$ at the inflow side that is formed by the tangent line at the radial exterior side of the blade edge 71 and the inflow plane E, is located in the range of 25° to 45°. The adjusting angle $\alpha$ at the outflow side, formed by the tangent line at the radial exterior side of the blade edge 72 and the outflow side A, is 70° to 90° to preferably 80°.

FIG. 8 shows the blade 7 as a part-that is developed in a plane (and can, for example, be punched in this way). The blade 7 is developed on both sides of an axis 76 that has an angle of slope $\beta$ of about 45° with respect to the blade root, with different radiuses R 1 and R 2. The diameters of the two bending cylinders on both sides around the axis 76 are for 2·R 1 = 120 mm and 2·R 2 = 30 mm. In the case of a radial top view of the blade 7, the bend R 1 of the blade from the direction of the inlet edge 71 is at first slight and then changes into a more extensive bend R 2.

We claim:

1. A miniature axial fan, particularly of an axially compact construction, comprising:

a central motor driving a rotor disk;

a one-piece molded unitary housing surrounding said rotor disk and including an inlet flow side being cylindrical with an approximately constant diameter extending rearwardly to and over the axial center of said housing;

said housing also including more than one web means on the outlet side for holding said central motor and rotor disk and a square flange plate means at the housing outlet side for defining the configuration thereof;

said housing further including a fastening pillar means having a continuous fastening bore which extends from said inlet side to said outlet side of the housing, said fastening pillar extending from the square flange plate at the outlet side to the inlet side of the housing; and wherein said rotor disk has a number of fan blades thereon, which number of blades differs from the number of web means.

* * * * *